US009079239B2

(12) United States Patent
Kojima et al.

(10) Patent No.: US 9,079,239 B2
(45) Date of Patent: Jul. 14, 2015

(54) METHOD FOR MANUFACTURING EASY OPEN END

(75) Inventors: Katsumi Kojima, Chiyoda-ku (JP); Hiroshi Kubo, Chiyoda-ku (JP); Yoichiro Yamanaka, Chiyoda-ku (JP); Masaki Tada, Chiyoda-ku (JP); Hiroki Iwasa, Chiyoda-ku (JP)

(73) Assignee: JFE Steel Corporation, Tokyo (JP)

( * ) Notice: Subject to any disclaimer, the term of this patent is extended or adjusted under 35 U.S.C. 154(b) by 975 days.

(21) Appl. No.: 13/131,150

(22) PCT Filed: Nov. 26, 2009

(86) PCT No.: PCT/JP2009/070265

§ 371 (c)(1), (2), (4) Date: Jul. 19, 2011

(87) PCT Pub. No.: WO2010/061961

PCT Pub. Date: Jun. 3, 2010

(65) Prior Publication Data

US 2012/0000340 A1 Jan. 5, 2012

(30) Foreign Application Priority Data

Nov. 27, 2008 (JP) ..... 2008-301774

(51) Int. Cl.

*B21D 51/44* (2006.01)
*B65D 17/00* (2006.01)
*B21D 51/38* (2006.01)

(52) U.S. Cl.

CPC ..... *B21D 51/443* (2013.01); *B65D 17/163* (2013.01); *B21D 51/383* (2013.01)

(58) Field of Classification Search

CPC ..... B21D 51/38; B21D 51/383; B21D 51/44; B21D 51/443; B21D 22/02; B21D 22/04; B21D 22/06

USPC ..... 220/619, 270, 269, 266, 265, 268, 276; 72/324, 379.2, 379.4, 347, 348, 325, 72/715; 413/8, 12, 14, 15, 17, 56

See application file for complete search history.

(56) References Cited

U.S. PATENT DOCUMENTS

| | | | | |
|---|---|---|---|---|
| 3,698,590 | A | 10/1972 | Cookson | |
| 4,503,989 | A * | 3/1985 | Brown et al. | 220/269 |
| 5,469,729 | A * | 11/1995 | Hager | 72/379.4 |
| 7,213,437 | B2 * | 5/2007 | Osumi et al. | 72/379.2 |
| 7,789,261 | B2 * | 9/2010 | Kubo et al. | 220/269 |

FOREIGN PATENT DOCUMENTS

| | | |
|---|---|---|
| JP | 4840553 | 12/1973 |
| JP | 55016800 | 2/1980 |

(Continued)

OTHER PUBLICATIONS

International Search Report for PCT/JP2009/070265 dated Dec. 28, 2009.

*Primary Examiner* — Shelley Self
*Assistant Examiner* — Pradeep C Battula
(74) *Attorney, Agent, or Firm* — RatnerPrestia

(57) ABSTRACT

A method of manufacturing an easy open end includes the steps of using a laminated steel sheet with resin films formed on both surfaces of the laminated steel sheet, and forming a panel structure and a score. A score die used for forming the score includes a scoring edge having a cross section in which a tip is a curve and two sides with the tip interposed therebetween are tangent to the curve. The tip is the curve having a curvature radius ranging from 0.2 to 0.4 mm, and the two sides have elevation angles θ in a range of $0.3 \leq \tan\theta \leq 1.0$ to an end surface. The panel structure is formed by a motion that is synchronous with a motion in which the score die is pressed to a surface of the laminated steel sheet during the formation of the score.

4 Claims, 6 Drawing Sheets

(56) References Cited

FOREIGN PATENT DOCUMENTS

| | | |
|---|---|---|
| JP | 06115546 | 4/1994 |
| JP | 9108758 | 4/1997 |
| JP | 1191775 | 4/1999 |
| JP | 2004298887 | 10/2004 |
| JP | 2006088209 | 4/2006 |

* cited by examiner

METHOD FOR MANUFACTURING EASY OPEN END

CROSS-REFERENCE TO RELATED APPLICATIONS

This application is the U.S. National Phase application of PCT International Application No. PCT/JP2009/070265, filed Nov. 26, 2009, and claims priority of Japanese Patent Application No. 2008-301774, filed Nov. 27, 2008, the disclosures of which PCT and priority applications are incorporated herein by reference in their entirety for all purposes.

TECHNICAL FIELD

The present invention relates to a method of manufacturing an easy open end that can be opened easily by hands breaking a presumptive opening part that is formed in an end of a can.

BACKGROUND ART

Referring to FIG. 2, an easy open end (also called an easy open cap) includes a body hook 6, a chuck wall 7, a panel 8, a score 11, a rivet 10, and a tab 9. The material of the easy open end may be an aluminum sheet or a steel sheet on which coating is applied or an organic resin film is laminated. Aluminum is frequently used as the material. The coated or laminated steel sheet is inexpensive as the material. However, after the end is processed, repair coating is necessary. Thus, the steel sheet is not economically advantageous. For these reasons, the steel sheet is not frequently used.

Under such circumstances, various trials to omit the repair coating of the steel-sheet easy open end have been made, by improving the processing method of the end and by using a laminated steel sheet suitable for the processing method.

FIG. 7 is a cross-sectional view showing a die for forming a score (cut groove) of an easy open end according to related art. Referring to FIG. 7, a V-shaped score die is used in the related art. Hence, the score (cut groove) for opening an end has a V-shaped cross section. When the material is the laminated steel sheet, the V-shaped score die breaks the laminated film and an iron portion is exposed. To secure corrosion resistance of the exposed portion, the repair coating has been necessary after scoring.

Patent document 1 tries to omit the necessity of the repair by using polyester resin and forming a score by two-step press (compound press) without using the conventional V-shaped score die.

Patent document 2 tries to omit the repair by using a curved-surface die for scoring to prevent the film from being broken.

Patent document 3 tries to improve openability and to omit the repair by specifying the cross-sectional shape of a curved-surface die used for scoring.

PATENT DOCUMENTS

[Patent Document 1] Japanese Unexamined Patent Application Publication No. 06-115546

[Patent Document 2] Japanese Unexamined Patent Application Publication No. 11-91775

[Patent Document 3] Japanese Unexamined Patent Application Publication No. 2004-298887

However, in the technique of patent document 1, the process of forming the score is the compound press. Scoring, which has included a single step, becomes scoring with two steps. Thus, the space for the two steps is necessary. The technique cannot be applied to conventional end processing equipment.

If scoring is performed with any of the techniques of patent documents 2 and 3, skewness may be generated, the skewness which has not been found when the conventional V-shaped score die was used. The skewness degrades the appearance of the end, and also degrades the corrosion resistance of the score.

The present invention provides a method of manufacturing an easy open end that does not need additional end processing equipment and that has no skewness and hence has good appearance.

SUMMARY OF THE INVENTION

[1] A method of manufacturing an easy open end that includes the steps of using a laminated steel sheet with resin films formed on both surfaces of the laminated steel sheet, and forming a panel structure and a score. A score die used for forming the score includes a scoring edge having a cross section in which a tip is a curve and two sides with the tip interposed therebetween are tangent to the curve. The tip is the curve having a curvature radius ranging from 0.2 to 0.4 mm, and the two sides have elevation angles θ in a range of $0.3 \leq \tan\theta \leq 1.0$ to an end surface. The panel structure is formed by a motion that is synchronous with a motion in which the score die is pressed to a surface of the laminated steel sheet during the formation of the score.

[2] In aforementioned [1], the panel structure is formed to satisfy the following expression:

$$-1.45t_0^2+1.76t_0-0.139 \leq h/(R^{0.5}) \leq -1.63t_0^2+2.31t_0+0.091,$$

where h (mm) is an average distance from a surface of the laminated steel sheet of the panel to a surface of the laminated steel sheet in which the score is formed, R (mm) is a distance from the center of the score to the center of the panel, and $t_0$ (mm) is a thickness of a blank sheet of the laminated steel sheet.

The easy open end is not skewed and hence has good appearance without additional end processing equipment. As described above, the easy open end does not need repair coating due to damage on resin films formed on both surfaces of the can end made of the laminated steel sheet when an expected opening is formed in the can end, and that has good openability such that even a child or an elderly person can open the end.

DETAILED DESCRIPTION OF THE INVENTION

Figure 1:
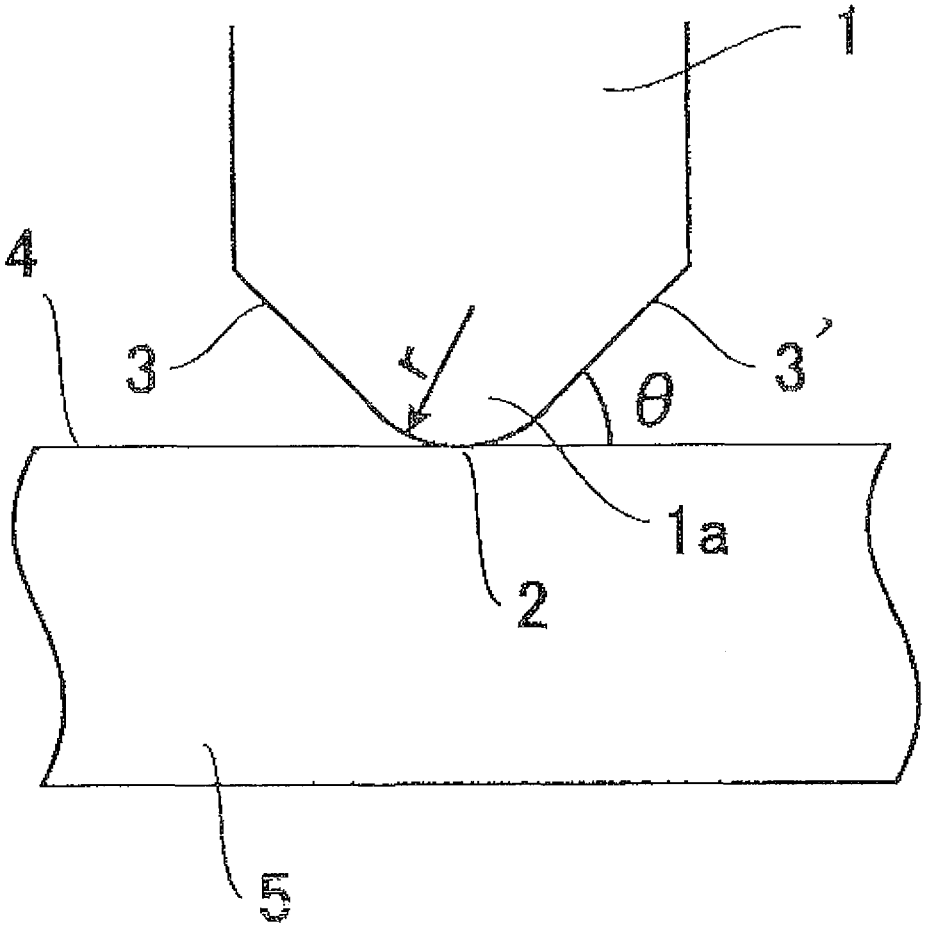
FIG. 1 is a cross-sectional view showing a score die according to an exemplary embodiment of the present invention.

First, a score die according to an exemplary embodiment of the present invention will be described. The score die has a scoring edge. The scoring edge has a tip with a cross section defined by a curve having a curvature radius ranging from 0.2 to 0.4 mm. Two sides with the tip of the scoring edge interposed therebetween are tangent to the curve that defines the tip of the scoring edge. The two sides have elevation angles θ in a range $0.3 \leq \tan\theta \leq 1.0$ to the surface of an end. The cross section of the tip passes through the center of a circular portion of the score die, and is perpendicular to the surface of the circle.

On the basis of the studies made by the inventors, not the cross-sectional shape of the score but the scored residual thickness dominantly affects the can opening force of an easy open end. That is, to obtain the same can end opening force as that of the related art, the scored residual thickness should be the same as that of the related art. The shape of the score does not have to be the V-shape like the related art. In an exemplary embodiment of the present invention, the shape of the score die is not the V-shape but has a curved-surface shape that prevents a film on a laminated steel sheet from being damaged by scoring. In particular, the scoring edge has a cross-sectional shape in which a tip is a curve and two line portions extending from the tip are tangent thereto with the tip curve interposed therebetween. With this shape (hereinafter, also referred to as the curved-surface shape), the repair can be omitted while the can end opening force is kept equivalent to that of the related art.

Hitherto, various trials have been made for the scoring method, and various score shapes have been suggested. However, when the processing for further decreasing the scored residual thickness is performed, or when the thickness of the laminated steel sheet is large and the processing to obtain the same scored residual thickness as that of the related art is performed, such processing becomes more severe. The effect for preventing the film from being damaged is not sufficient.

Regarding the reasons of the insufficient effect, during the scoring with the curved-surface shape, the boundary between a part in which the score die contacts the steel sheet and a part in which the score die does not contact the steel sheet is more likely subjected to a shearing condition as the inclination of the tangent at the boundary point is larger. If the inclination is perpendicular (when the processing is performed with a score die including a scoring edge with a rectangular cross section), the boundary point is subjected to a shearing condition. In contrast, if the inclination is approximated to zero (the lowest point in the curved-surface die), the boundary point has an extremely small shear component. It is found that the curved-surface die has a larger shear component as the inclination of the tangent increases. The shear component is small at the lowest portion of the curved surface whereas the shear component is largest at the end portions. In addition, the inclinations at respective points on the curved surface can be expressed by using tan θ (angles defined by lines connecting the respective points, the center points of the curve, and the lowest point of the curve). When θ becomes large, the inclination rapidly increases.

During scoring, pressure is applied only by a portion near the lowest portion of the curved surface in the very early phase. As processing progresses, even the ends of the curved surfaces are processed. In the severe processing, the breakage of a film has been observed not at the thinnest portion of the film but at a portion of the film near the edge of the score. This is possibly because the shear component becomes large at that portion.

On the basis of the observed results, various tests have been made by applying a solution for preventing the inclination from being excessively large to the die. Consequently, the score die specified as follows can be completed.

FIG. 1 is a cross-sectional view showing a score die according to an embodiment of the present invention. Referring to FIG. 1, a tip 2 of a scoring edge 1*a* of a score die 1 is formed of a curve. Two sides 3, 3' with the tip 2 interposed therebetween are tangent to the curve of the tip 2. The scoring edge 1*a* is a protruding portion of the score die that forms a score in an end body (laminated steel sheet) 5 by pressing the end body 5. In FIG. 1, θ represents an elevation angle θ of each of the sides 3, 3' to an end surface 4.

According to an exemplary embodiment of the present invention, the curvature radius ranges from 0.2 to 0.4 mm, and the function tan θ of the elevation angle θ ranges from 0.3 to 1.0.

The tip is the curve and the two sides with the tip interposed therebetween are tangent to the curve:

If the two sides 3, 3' with the tip 2 of the score die 1 interposed therebetween are not tangent to the curve of the tip 2, the elevation angles to the surface of the steel sheet rapidly change at the points at which the sides 3, 3' intersect with the curve of the tip 2. The processing becomes severe at the portions. The film is likely to be damaged. In contrast, if the sides 3, 3' are tangent to the curve of the tip 2, the elevation angles to the surface of the steel sheet smoothly change at the portions (the contact points). The film is less likely to be damaged.

The curvature radius ranges from 0.2 to 0.4 mm, and $0.3 \leq \tan\theta \leq 1.0$:

In the curvature radius is 0.2 mm or larger, and the tan θ is 1.0 or smaller, the film is less likely to be broken as compared with that the processing is performed with a curved surface merely having a curvature radius R. In contrast, if the curvature radius is larger than 0.4 mm, the score width becomes too large. At the same time, the processing area increases, and hence the film processing becomes severe. If the curvature radius is smaller than 0.2 mm, the ratio of the sides increases, and hence the part with the large shear component increases, and the film is more likely to be damaged. If tan θ is smaller than 0.3, the score width becomes too large, and the processing area increases. This is not preferable because the film processing may tend to be severe.

The effect of the score die as specified above will be described. Since the sides 3, 3' are tangent to the curve of the tip 2, the shear component included in the stress that is exerted during scoring can be decreased. During scoring when the cross section is a regular circle, the shear component increases as the position is more distant from the center (the lowest portion of the score). The idea of the tangent is to prevent the ratio of the shear component from becoming larger than a predetermined level. Since the sides are tangent to the regular circle, the shear component becomes the largest at the tangential portion in the die according to an exemplary embodiment of the present invention (however, the shear component does not become larger than that of the regular circle). Regarding only this point, the length of the tangential portion is preferably small. To decrease the length of the tangential portion, the curvature radius of the regular circle may be increased. In this case, the entire level of processing becomes more severe as the processing amount increases. The film is likely to be damaged. In contrast, if the curvature radius of the regular circle is decreased, the ratio of the tangential portion increases, and hence the part with the large shear component increases. The film is more likely to be damaged. By specifying that the curvature radius ranges from 0.2 to 0.4 mm, the aforementioned problems can be addressed.

The sides 3, 3' with the tip 2 interposed therebetween are tangent to the curve of the tip 2. Hence, the effect for preventing the film from being damaged can be maximally obtained. However, as described above, unless the elevation angles to the surface of the steel sheet rapidly change at the points at which the sides 3, 3' intersect with the curve of the tip 2, the effect for preventing the film from being damaged can be attained. Regarding these points, according to the present invention, the two sides 3, 3' with the tip 2 of the scoring edge 1*a* interposed therebetween may not exactly be tangent to the curve of the tip 2, but may be sides substantially tangent to the curve. Herein, the sides substantially tangent to the curve are sides that are inclined to the exact tangent by a certain degree, for example, an angle of ±3 degrees.

Next, a process of manufacturing the easy open end according to an exemplary embodiment of the present invention by using the aforementioned score die will be described.

Figure 2:
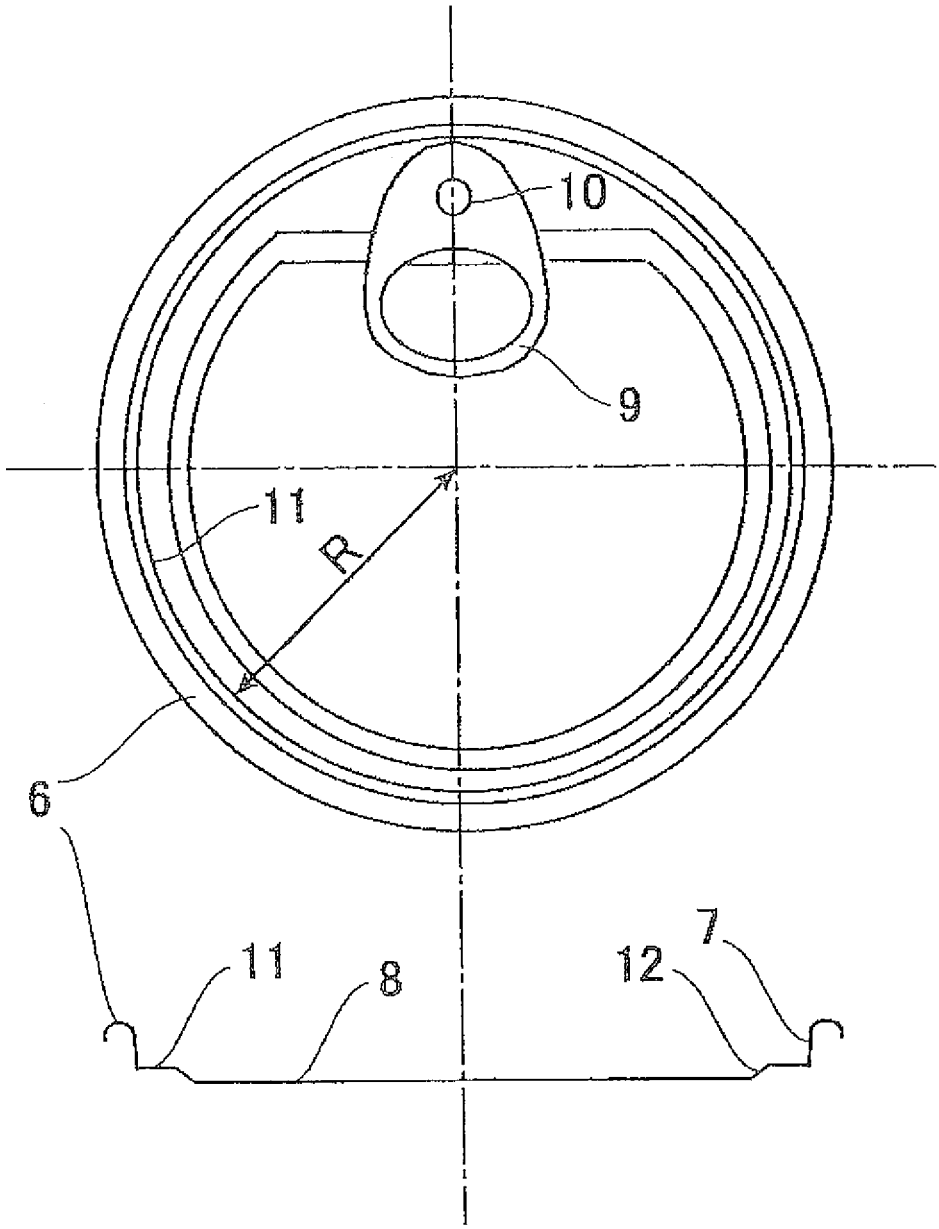
FIG. 2 illustrates a configuration of an easy open end according to an exemplary embodiment of the invention.

The overview of the conventional processing process is as follows. First, the sheet material is punched to form a circular blank, and then shallow drawing by pressing is performed. Thus, a basic shell including a body hook 6, a chuck wall 7, and a panel 8 shown in FIG. 2 is made. The body hook 6 may be bent toward the center portion of the basic shell by curing or the like. The lower surface of the body hook 6 shown in FIG. 2 is coated with a resin compound (not shown) that is flexible to keep the gas tightness after the body hook 6 as the end is seamed with the can body. A rivet 10 is formed at the panel 8 of the basic shell. The rivet 10 is provided for attaching tab 9 thereto later. Then, a score 11 and a panel structure 12 are formed in that order or in the reverse order. Finally, the tab 9 is attached. Thus, the easy open end is completed. The panel structure 12 is provided by pressing to allow the finger to be hooked to the tab 9 when the can is opened, and to increase the strength of the end to be separated.

When the score is formed with the score die in the aforementioned process, a bulged skewness may appear in the panel 8 and the panel structure 12 after the completion depending on the condition. The phenomenon is not noticeable when the score die having the conventional V-shaped cross section is used. The phenomenon is peculiar to the score die having the curved-surface shape like that of exemplary embodiments of the present invention. When the score die of the present invention is used and the bulged skewness appears in the panel structure 12, the corrosion resistance of the score is degraded.

Such a phenomenon occurs because of the cross-sectional shape of the score. Regarding the score shape according to an exemplary embodiment of the present invention, the volume of the material that is pushed out from the portion processed by scoring is large as compared with the conventional V-shape. The volume is shifted from the score toward the chuck wall 7 or the center of the panel 8, and hence the skewness may appear. At this time, since the chuck wall 7 is formed into a rim-like shape over the entire circumference of the end and has a rigid structure, the chuck wall 7 is hardly skewed. However, the panel 8 has a flat surface shape and is easily bent. The skewness may be noticeable in the panel 8.

The effect of the skewness to the corrosion resistance can be explained in relation to the process of manufacturing the easy open end. As mentioned above, the score 11 and the panel structure 12 may be formed in the panel 8 such that (1) the panel structure 12 is formed after the score 11 is formed, or that (2) the score 11 is formed after the panel structure 12 is formed.

In the case of (1), since the score 11 is formed in the panel 8, which is flat (excluding the rivet 10) and easily bent, a skewness may noticeably appear and the center portion of the panel 8 may be bulged. The skewness causes the score 11 to be deformed, and the laminated film on the score 11 to be damaged. Then, the panel structure 12 is formed at the previously formed panel 8. At this time, the skewness at the center portion of the panel 8 is partly corrected when the panel structure 12 is formed. However, a skewness, which cannot be corrected, may remain. The score 11 is also deformed when the panel structure 12 is formed, and the laminated film thereon is damaged.

In contrast, in the case of (2), the panel structure 12 is formed first. The score 11 is formed in the panel 8, which has become rigid because the panel structure 12 has been formed. Thus, the skewness having the bulged shape, which is found in the center portion of the panel 8 during scoring in the case of (1), is reduced. However, the skewness may become found in a portion near the score 11. Due to the skewness in the portion near the score 11, the score 11 is deformed, and the laminated film on the score 11 is damaged.

As described above, the skewness of the end may appear in either case of (1) and (2) in the process of manufacturing the easy open end according to the related art. The skewness causes the score 11 to be deformed, and hence, the film thereof is damaged, and the corrosion resistance is degraded.

To avoid this phenomenon, the inventors have concluded that an effective way is synchronously performing a motion, in which the score die 1 is pressed to the surface of the laminated steel sheet to form the score 11, and a motion, in which the panel structure 12 is formed. According to an exemplary embodiment of the present invention, the "synchronously performing" or "forming by synchronous motions" means that the step of forming the score and the step of forming the panel structure are performed simultaneously or as a continuous single step. In the case of "synchronously performing" or "forming by synchronous motions", any of the step of forming the score and the step of forming the panel structure can be started first. In this step, the time in which the score die is in contact with the laminated steel sheet may preferably overlap with the time in which a press for a panel is in contact with the laminated steel sheet. In particular, the timing at which the score die reaches the lowest point may be preferably simultaneous with the timing at which the press for the panel reaches the lowest point.

The reason is as follows. The skewness due to the formation of the score 11 is generated when the volume of the material that is pushed out from the processed portion because of the formation of the score 11 is shifted from the score 11 toward the chuck wall 7 or the center of the panel 8. Thus, as long as the volume of the material that is pushed out from the processed portion is absorbed by proper means, the skewness may be restricted. However, if the absorbing means is an additional step to the conventional process of manufacturing the end, the number of steps in the manufacturing process increases, which is not desirable. Owing to this, it is the most reasonable that the conventional step of forming the panel structure 12 serves as the absorbing means. That is, the panel structure 12 is formed by the motion synchronous with the motion in which the score die 1 is pressed to the surface of the laminated steel sheet. Accordingly, the score 11 is formed synchronously with the panel structure 12.

Figure 3:
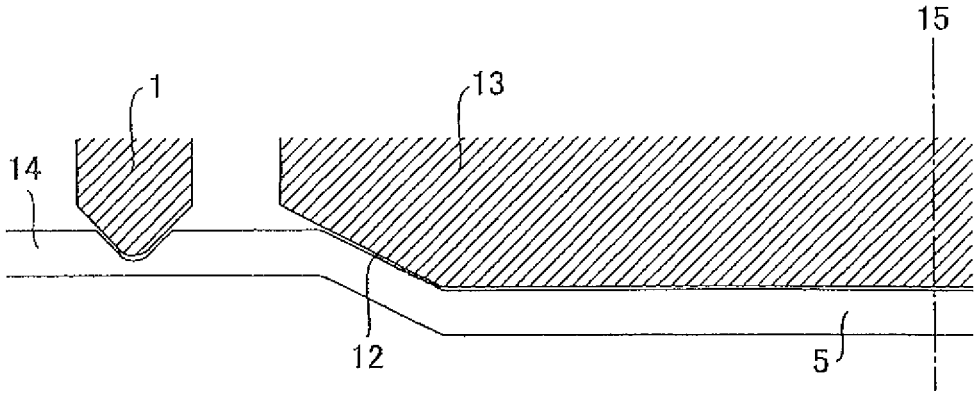
FIG. 3 is a cross-sectional view showing synchronous formation of a score and a panel structure according to an exemplary embodiment of the present invention.

The synchronous motions are carried out, for example, as follows. The end is processed by using a processing machine with a reciprocating motion, such as a press. The processing machine has a structure in which the score die 1 and a panel die 13 that forms the panel structure 12 process the laminated steel sheet 5 in a single reciprocating motion of the press as shown in FIG. 3. Accordingly, the score 11 and the panel structure 12 can be formed by the synchronous motion. The score die 1 and the panel die 13 may be a combination of separate individual dies, or may be integrated. Reference numeral 14 in FIG. 3 is the basic shell.

In the synchronous motion, the score 11 is formed to have a proper scored residual thickness. The proper scored residual thickness can be selected from a range that satisfies both can opening force and the strength of the score. The range is preferably from about 0.03 to 0.1 mm.

Figure 6:
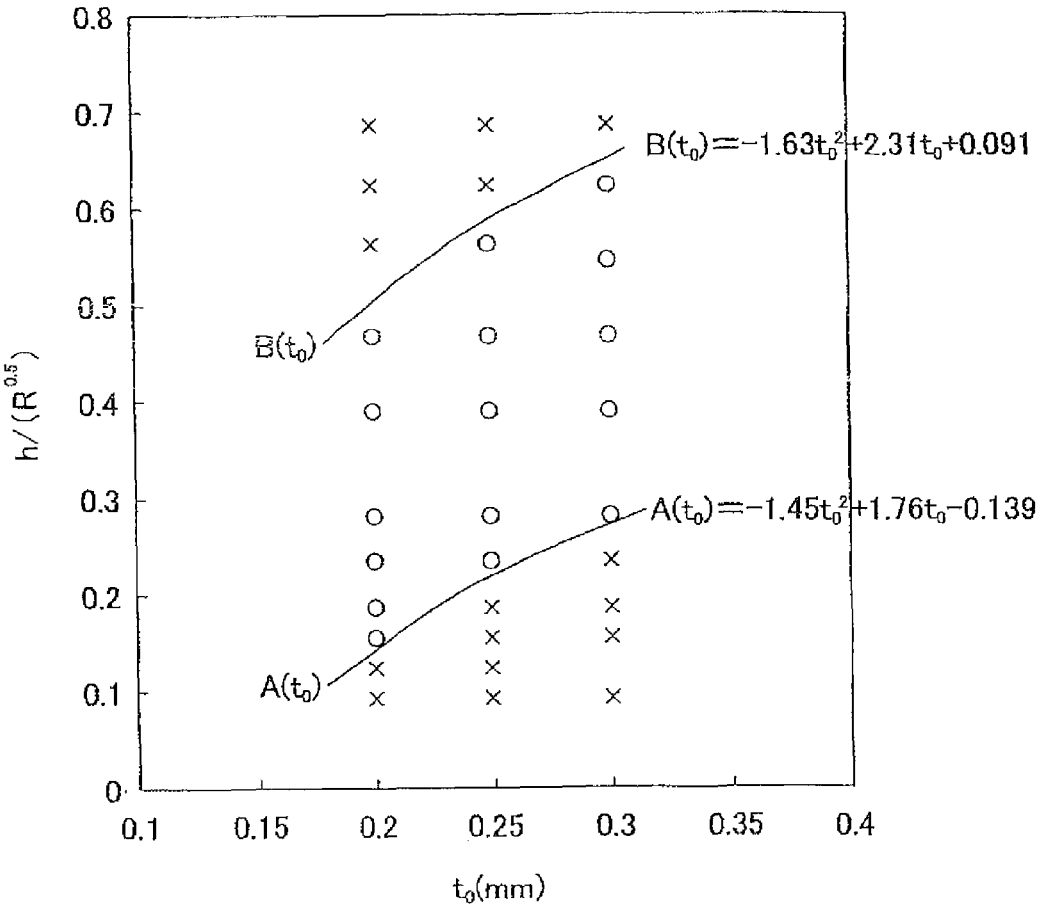
FIG. 6 illustrates the effect of the thickness of a sheet to corrosion resistance.
Figure 7:
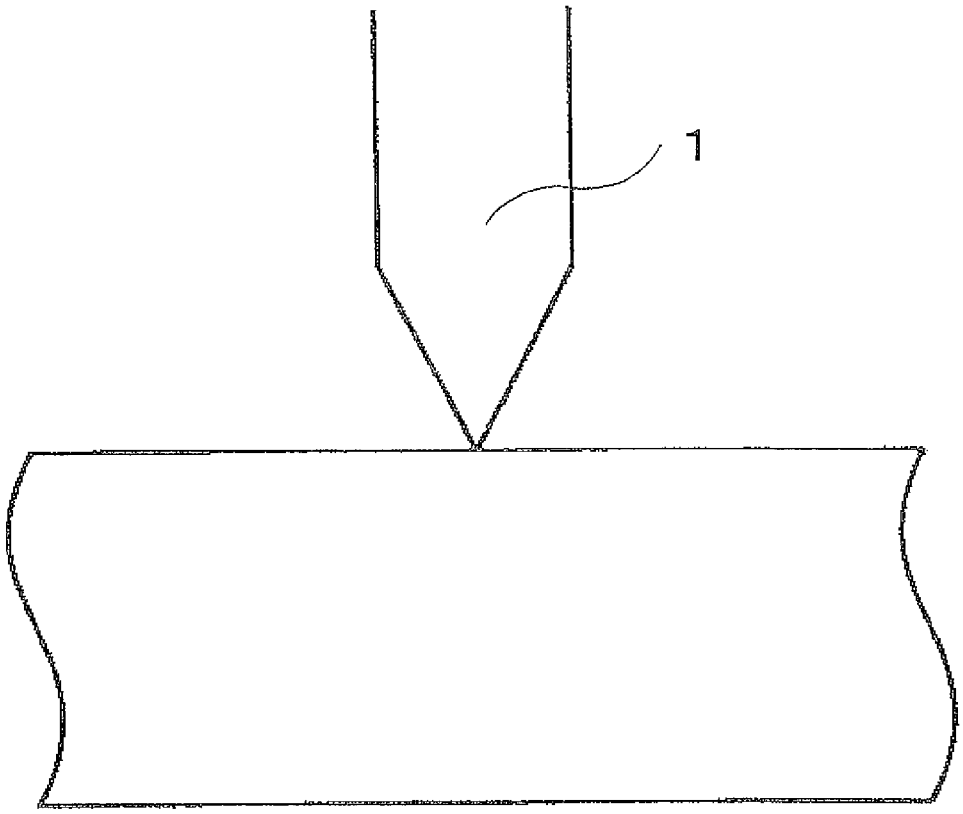
FIG. 7 is a cross-sectional view showing a conventional score die.

The inventors have concluded that, when h (mm) is an average distance from the surface of the laminated steel sheet of the panel to the surface of the laminated steel sheet in which the score is formed, R (mm) is a distance from the center of the score to the center of the panel (radius of a circle defined by the score), and $t_0$ (mm) is a thickness of the blank sheet of the laminated steel sheet of FIG. 6, the skewness can be restricted and the corrosion resistance can be prevented from being degraded as long as the score is formed to satisfy Expression (1) as follows:

$$-1.45t_0^2+1.76t_0-0.139 \le h/(R^{0.5}) \le -1.63t_0^2+2.31t_0+0.091 \quad (1).$$

The conditions are given below.

Figure 4:
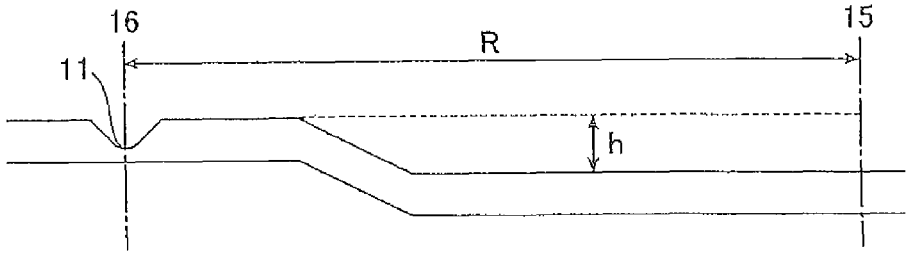
FIGS. 4(*a*), 4(*b*), and 4(*c*) illustrate values h and R after the formation of an exemplary panel structure.
Figure 4:
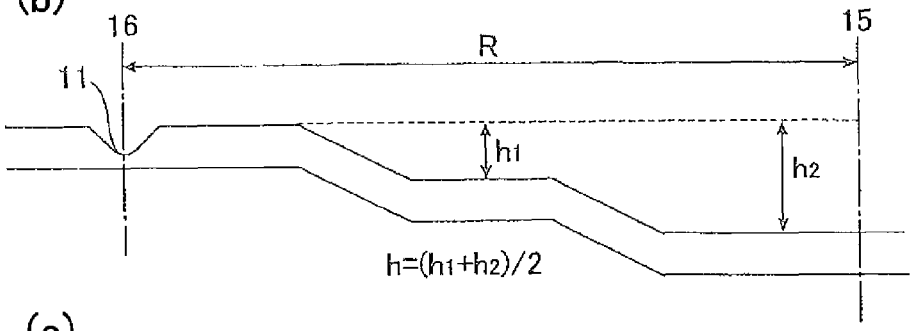
Figure 4:
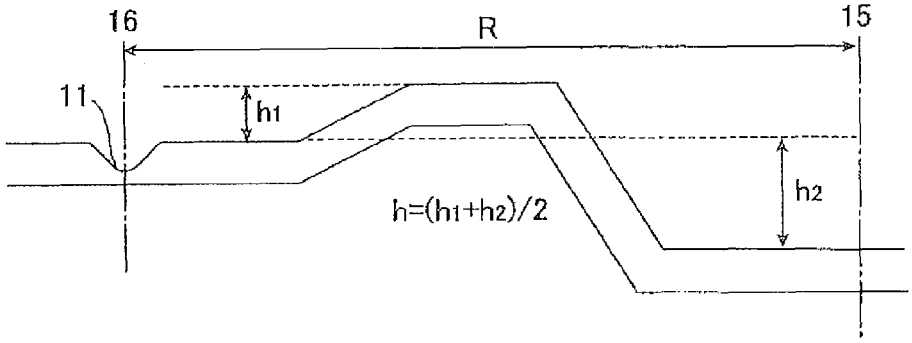

As shown in FIG. 4(*a*), h is the average distance (height) from the surface of the laminated steel sheet of the panel to the surface of the laminated steel sheet in which the score is formed (also referred to as "panel average height"). If a panel structure has a step as shown in FIG. 4(*b*), the respective distances are averaged. If a panel structure protrudes as shown in FIG. 4(*c*), the average distance is also counted from the surface of the laminated steel sheet in which the score is formed. The score is formed as a circle as shown in FIG. 2 to be concentric with the panel. R is the distance from a center 15 of the score circle (the center of the panel) to a center 16 of the formed score. Value $t_0$ is a value corresponding to the blank sheet of the laminated steel sheet, the value obtained by subtracting the thicknesses of the laminated films on both sides of the sheet from the entire thickness of the sheet.

Expression (1) is obtained on the basis of the experimental results, and hence, it is difficult to theoretically strictly explain the meaning of the result. However, it is believed that the result generally has the following meaning. As h increases, the panel structure is in the state in which the laminated steel sheet is more deeply pressed. Thus, the deformation amount is large. This makes contribution to absorbing the volume that is pushed out from the score. If h is too large, although the volume that is pushed out from the score is absorbed, the laminated steel sheet may be excessively deformed. It is not desirable. In order to properly absorb the volume that is pushed out from the score, h has to be within a proper range. According to an exemplary embodiment of the present invention, instead of h, $h/(R^{0.5})$ is used as the index for setting the proper range of h. The reason is given below.

Figure 5:
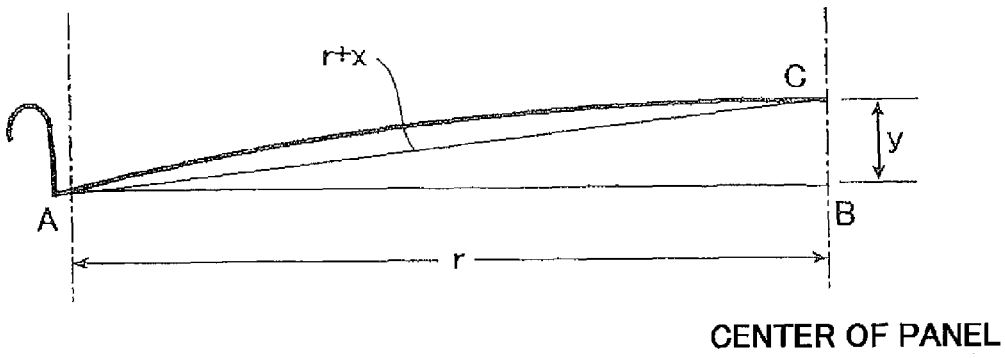
FIG. 5 is a schematic illustration showing skewness that is bulged during scoring.

As described above, the skewness having the bulged shape appears in the panel due to the volume that is pushed out from the score during scoring. FIG. 5 illustrates one side of the cross section of the end, the cross section passing through the center of the panel. The bulged shape is substantially arcuate. To simplify the description, the bulged shape is approximated to a line AC. Then, Expression (2) is established as follows:

$$r^2+y^2=(r+x)^2 \quad (2),$$

where r is a length of the line AB, which is a distance from the center of the panel to an end of the bulged shape, y is a length of a line BC, which is a height of the bulged shape, x is an extension due to the volume that is pushed out from the score during scoring, and (r+x) is a length of a line AC. When Expression (2) is modified, Expression (3) is obtained as follows:

$$y=\{(r+x)^2-r^2\}^{0.5}=r^{0.5}\cdot(2x+x^2/r)^{0.5} \quad (3).$$

x is very small and is also small for r. Thus, $x^2/r$ is negligible for 2x. Thus, Expression (3) can be approximated to Expression (4) as follows:

$$y/(r^{0.5}) \approx (2x)^{0.5} \quad (4).$$

The present invention makes it possible to correct the skewness having the bulged shape as shown in FIG. 5 by the panel structure having the height h. Accordingly, y in Expression (4) can be associated with h. Also, r in FIG. 5 substantially corresponds to the distance R of the score from the center of the panel. That is, $y/(r^{0.5})$ is associated with $h/(R^{0.5})$.

As described above, since $h/(R^{0.5})$ is associated with the volume that is eliminated from the score during scoring, $h/(R^{0.5})$ is used as the index for expressing the level of processing of the panel structure. The thickness of the sheet relates to the upper and lower limits of $h/(R^{0.5})$ as follows.

As mentioned above, the score processing portion 11 is advantageously formed to have the proper scored residual thickness. The skewness in the panel to be improved by embodiments of the present invention relates to the volume that is pushed out from the score processing portion. The volume should be determined by the relationship between the scored residual thickness and the thickness of the blank sheet of the laminated steel sheet. To allow the scored residual thickness to fall within a predetermined range, the volume that is pushed out from the score is larger as the thickness of the blank sheet to be used is larger. Thus, the thickness of the blank sheet affects $h/(R^{0.5})$.

The specific effect of the sheet thickness has been studied, and the result is shown in FIG. 6. The conditions of processing are as follows. The curvature radius of the tip of the score is 0.3 mm, tan θ is 0.7, the sheet thickness $t_0$ is 0.20 mm, the scored residual thickness is 0.07 mm, and the radius R of the circle defined by the score is 41 mm. Also, the score and the panel structure are processed synchronously. White circles (good) and crosses (bad) in the drawing are the evaluation results of the corrosion resistance after the formation of the score. The portion to be processed is immersed in an electrolytic solution (a 5% solution of KCl at ordinary temperature), a voltage of 6.2 V is applied between the steel sheet and the electrolytic solution, and a current value is measured. The evaluation is good (circle sign) if the measured current value is smaller than 0.1 mA. The evaluation is bad (cross sign) if the measured current value is 0.1 mA or larger. The region smaller than 0.1 mA represents that the corrosion resistance is practically sufficient. Referring to FIG. 6, the range of $h/(R^{0.5})$ with good corrosion resistance is $A(t_0) \le h/(R^{0.5}) \le B(t_0)$ Herein, $A(t_0)=-1.45t_0^2+1.76t_0-0.139$, $B(t_0)=-1.63t_0^2+2.31t_0+0.091$.

When h is measured, the rivet is not included in the measurement. This is because the rivet is formed prior to the scoring and the panel processing, and the rivet is processed by reducing the sheet thickness of the portion to be processed. No contribution is made to absorbing the volume that is pushed out from the score processing portion.

The laminated steel sheet can be manufactured by forming resin films on both surfaces of any of various kinds of surface-treated steel sheets as the material, by adhering, laminating, etc. This surface-treated steel sheet is preferably prepared by plating the surface of a steel sheet with one kind, two kinds or more of tin, zinc, nickel or chromium or their alloys, and by further subjecting the plated steel sheet to a chemical conversion treatment such as a chromate treatment or a phosphate treatment. Of those surface-treatment steel sheets, the especially preferred one is so-called tin-free steel, on which a chromate film of a metallic chromium layer and an overlying chromium hydrate layer are formed.

As the resin film, a resin film composed of one kind, two kinds or more of thermoplastic resins such as polyester or polyamide is used in view of the performances of food sanitization, corrosion resistance, workability, and the like. It is more desirable for balancing the film properties including a film breaking extension, a tensile strength, a tensile elasticity, and the like, at a high level to use the film made of one layer, two layers or more of polyester resins.

The specific polyester resin film to be used is a linear thermoplastic polyester film produced by the condensation polymerization of dicarboxylic acid and diol, and is represented by polyethylene terephthalate. The dicarboxylic component is a single substance or mixture of terephthalic acid, isophthalic acid, phthalic acid, and the like, and the diol component is a single substance or mixture of ethylene glycol, butadiene glycol, decanediol, and the like. Alternatively, a copolymer of two kinds or more of the dicarboxylic component and the diol component, or a copolymer of other monomers or polymers such as diethylene glycol may be used. For the laminating method, the film itself thermally adheres to the surface of the steel sheet, or a thermosetting adhesive is applied to be attached to the surface of the steel sheet.

The resin film is easily broken by the processing, if the thickness of the resin film is smaller than 10 μm. If the thickness is larger than 100 μm, feathering property is likely degraded after the can is opened, and the cost increases, which is economically disadvantageous. Therefore, it is desirable that the resin film has a thickness within a range of from 10 to 100 μm.

The laminated steel sheet preferably has a thickness ranging from 0.15 to 0.40 mm, and the scored residual thickness preferably ranges from 0.03 to 0.1 mm, more particularly, from 0.05 to 0.07 mm for good operability.

The present invention can be applied to a can end of any of pull-top tab type, stay-on tab type and full-open type.

EXAMPLE (Laminated Steel Sheet)

Chromium metal layers were formed by a quantity ranging from 100 to 120 mg/m$^2$ on both surfaces of each of three steel sheets having thicknesses of 0.2, 0.25, and 0.3 mm by chromating, and then chromate films formed of hydrated chromium oxide layers were formed by a quantity ranging from 14 to 18 mg/m$^2$, as converted into chromium metal, on the chromium metal layers. Thus, tin-free steel was prepared. Then, PET (polyethylene terephthalate) films with a thickness of 20 μm was laminated on both surfaces of the tin-free steel.

(Basic Shell)

The laminated steel sheets thus prepared were pressed, and hence basic shells with a 307 diameter (i.e., the inner diameter of a chuck wall being 86 mm) and a 603 diameter (i.e., the inner diameter of a chuck wall being 156 mm) were fabricated.

(Score Die)

Referring to FIG. 1, the die, in which the cross-sectional shape of the scoring edge 1*a* was substantially triangular, the tip 2 of the scoring edge 1*a* was formed of the curve with the curvature radius R, the two sides 3, 3' with the tip 2 interposed therebetween are tangent to the curve of the tip 2, was used. The curvature radius r of the tip 2 and the elevation angles θ of the sides 3, 3' to the end surface were varied as shown in Table 1. The diameter of the score circle was determined as 82 mm (radius of 41 mm) for the 307-diameter basic shell. The diameter of the score circle was determined as 152 mm (radius of 76 mm) for the 603-diameter basic shell.

(Panel Structure Die)

The panel structure was concentric with the score circle. The die was used so that the diameter of the panel structure was determined as 74 mm (radius of 37 mm) for the 307-diameter, and the diameter of the panel structure was determined as 144 mm (radius of 72 mm) for the 603-diameter.

(Score Forming and Panel-Structure Forming)

The score die and the panel-structure die were used, and the score and the panel structure were formed. The score was formed such that the scored residual thickness was 0.07 mm. The score and the panel structure were formed such that the panel structure was formed after the score was formed (in an "individual" manner), and that the score and the panel structure were synchronously formed (in a "synchronous" manner). Also, the average distance of the panel structure (also referred to as "panel average height") h was varied.

(Evaluation on Corrosion Resistance)

The corrosion resistance of the steel sheet after the formation of the score was evaluated as follows.

The processed portion was immersed in an electrolytic solution (a 5% solution of KCl at ordinary temperature), a voltage of 6.2 V was applied between the steel sheet and the electrolytic solution, and a current value was measured. The evaluation was very good (double circle sign) if the measured current value was lower than 0.01 mA. The evaluation was good (circle sign) if the measured current value was 0.01 mA or higher and smaller than 0.1 mA. The evaluation was not bad (triangle sign) if the measured current value was higher than 0.1 mA and smaller than 1 mA. The evaluation was bad (cross sign) if the measured current value was 1 mA or larger.

(Laminated Steel Sheet)

The results are shown in Table 1 with the conditions.

TABLE 1

| No. | Curvature radius r(mm) | Elevation angle tanθ | Blank sheet thickness $t_0$ (mm) | Scored residual thickness $t_s$(mm) | Score circle radius R(mm) | Formation timing of score and panel structure | Panel average height h(mm) | $h/(R^{0.5})$ | $A(t_0)$ * 1) | $B(t_o)$ * 2) | Evaluation |
|---|---|---|---|---|---|---|---|---|---|---|---|
| 1 | 0.2 | 0.7 | 0.20 | 0.07 | 41 | Individual | 0.9 | 0.141 | 0.155 | 0.487 | Δ |
| 2 | 0.3 | 0.7 | 0.20 | 0.07 | 41 | Individual | 2.4 | 0.375 | 0.155 | 0.487 | Δ |
| 3 | 0.4 | 0.7 | 0.30 | 0.07 | 41 | Individual | 1.5 | 0.234 | 0.258 | 0.636 | Δ |
| 4 | 0.5 | 0.7 | 0.20 | 0.07 | 41 | Individual | 3.2 | 0.500 | 0.155 | 0.487 | X |
| 5 | 0.3 | 1.1 | 0.20 | 0.07 | 41 | Individual | 2.4 | 0.375 | 0.155 | 0.487 | X |
| 6 | 0.2 | 0.7 | 0.20 | 0.07 | 41 | Synchronous | 0.9 | 0.141 | 0.155 | 0.487 | ○ |

TABLE 1-continued

| No. | Curvature radius r(mm) | Elevation angle tanθ | Blank sheet thickness $t_0$ (mm) | Scored residual thickness $t_s$(mm) | Score circle radius R(mm) | Formation timing of score and panel structure | Panel average height h(mm) | $h/(R^{0.5})$ | $A(t_0)$ * 1) | $B(t_o)$ * 2) | Evaluation |
|---|---|---|---|---|---|---|---|---|---|---|---|
| 7 | 0.3 | 0.7 | 0.20 | 0.07 | 41 | Synchronous | 3.2 | 0.500 | 0.155 | 0.487 | ○ |
| 8 | 0.4 | 0.7 | 0.25 | 0.07 | 41 | Synchronous | 1.2 | 0.187 | 0.210 | 0.566 | ○ |
| 9 | 0.3 | 0.3 | 0.30 | 0.07 | 41 | Synchronous | 1.5 | 0.234 | 0.258 | 0.636 | ○ |
| 10 | 0.3 | 1.0 | 0.20 | 0.07 | 41 | Synchronous | 3.2 | 0.500 | 0.155 | 0.487 | ○ |
| 11 | 0.1 | 0.7 | 0.20 | 0.07 | 41 | Synchronous | 0.9 | 0.141 | 0.155 | 0.487 | X |
| 12 | 0.5 | 0.7 | 0.20 | 0.07 | 41 | Synchronous | 3.2 | 0.500 | 0.155 | 0.487 | X |
| 13 | 0.3 | 1.1 | 0.20 | 0.07 | 41 | Synchronous | 0.9 | 0.141 | 0.155 | 0.487 | X |
| 14 | 0.3 | 0.2 | 0.20 | 0.07 | 41 | Synchronous | 3.2 | 0.500 | 0.155 | 0.487 | X |
| 15 | 0.2 | 0.7 | 0.20 | 0.07 | 41 | Synchronous | 1.8 | 0.281 | 0.155 | 0.487 | ◎ |
| 16 | 0.3 | 0.7 | 0.20 | 0.07 | 76 | Synchronous | 3.0 | 0.344 | 0.155 | 0.487 | ◎ |
| 17 | 0.3 | 0.7 | 0.20 | 0.07 | 41 | Synchronous | 1.8 | 0.281 | 0.155 | 0.487 | ◎ |
| 18 | 0.4 | 0.7 | 0.25 | 0.07 | 76 | Synchronous | 3.0 | 0.344 | 0.210 | 0.566 | ◎ |
| 19 | 0.1 | 0.7 | 0.20 | 0.07 | 41 | Synchronous | 2.4 | 0.375 | 0.155 | 0.487 | X |
| 20 | 0.5 | 0.7 | 0.20 | 0.07 | 41 | Synchronous | 2.4 | 0.375 | 0.155 | 0.487 | X |
| 21 | 0.3 | 1.1 | 0.20 | 0.07 | 41 | Synchronous | 2.4 | 0.375 | 0.155 | 0.487 | X |
| 22 | 0.3 | 0.2 | 0.20 | 0.07 | 41 | Synchronous | 2.4 | 0.375 | 0.155 | 0.487 | X |
| 23 | 0.2 | 0.7 | 0.30 | 0.07 | 41 | Synchronous | 2.0 | 0.312 | 0.258 | 0.636 | ◎ |
| 24 | 0.3 | 0.7 | 0.30 | 0.07 | 76 | Synchronous | 2.0 | 0.229 | 0.258 | 0.636 | ○ |
| 25 | 0.3 | 0.3 | 0.30 | 0.07 | 41 | Synchronous | 2.0 | 0.312 | 0.258 | 0.636 | ◎ |
| 26 | 0.3 | 1.0 | 0.30 | 0.07 | 76 | Synchronous | 2.0 | 0.229 | 0.258 | 0.636 | ○ |
| 27 | 0.1 | 0.7 | 0.30 | 0.07 | 41 | Synchronous | 2.5 | 0.390 | 0.258 | 0.636 | X |
| 28 | 0.5 | 0.7 | 0.30 | 0.07 | 41 | Synchronous | 2.5 | 0.390 | 0.258 | 0.636 | X |
| 29 | 0.3 | 1.1 | 0.30 | 0.07 | 41 | Synchronous | 2.5 | 0.390 | 0.258 | 0.636 | X |
| 30 | 0.3 | 0.2 | 0.30 | 0.07 | 41 | Synchronous | 2.5 | 0.390 | 0.258 | 0.636 | X |

* 1) $A(t0) = -1.45\,t_0^2 + 1.76\,t_0 - 0.139$
* 2) $B(t_0) = -1.63t_0^2 + 2.31t_0 + 0.091$

As shown in Table 1, No. 4 and No. 5 show the shapes of the score dies not within the preferred range of the present invention. Also, since the score and the panel structure are individually formed, the corrosion resistance is degraded.

No. 1 to No. 3 indicate the shapes of the score dies within the preferred range of the present invention. However, the score and the panel structure are individually formed. Although the corrosion resistances of No. 1 to No. 3 are slightly better than No. 4 and No. 5, the corrosion resistances are still required to be improved.

No. 6 to No. 10 indicate the shapes of the score dies within the preferred range of the present invention. Also, the score and the panel structure are synchronously formed. Accordingly, No. 6 to No. 10 exhibit good corrosion resistances as compared with No. 1 to No. 3 although $h/(R^{0.5})$, which is the formation condition of the panel structure, does not meet the preferred condition specified by the present invention.

No. 11 to No. 14 indicate the shapes of the score dies not within the preferred range of the present invention. The score and the panel structure are synchronously formed, however, No. 11 to No. 14 exhibit bad corrosion resistances.

No. 15 to No. 18, No. 23, and No. 25 indicate the shapes of the score dies within the preferred range of the present invention, and the score and the panel structure are synchronously formed. In addition, $h/(R^{0.5})$, which is the formation condition of the panel structure, meets the preferable condition specified by the present invention. Thus, No. 15 to No. 18, No. 23, and No. 25 exhibit very good corrosion resistances.

No. 24 and No. 26 indicate the shapes of the score dies within the preferred range of the present invention. Also, the score and the panel structure are synchronously formed. These are examples of the present invention. No. 24 and No. 26 exhibit relatively good corrosion resistances like No. 6 to No. 10 although $h/(R^{0.5})$, which is the formation condition of the panel structure, does not meet the preferred condition specified by the present invention.

No. 19 to No. 22, and No. 27 to No. 30 indicate the shapes of the score dies not within the preferred range of the present invention. Although the score and the panel structure are synchronously formed and $h/(R^{0.5})$, which is the formation condition of the panel structure, is within the preferred range of the present invention, No. 19 to No. 22, and No. 27 to No. 30 exhibit bad corrosion resistances.

The present invention provides the easy open end that is not skewed and hence has good appearance without additional end processing equipment. As described above, the present invention provides the easy open end that does not need repair coating due to damage on the resin films formed on both surfaces of the can end when an opening is formed in the can end made of the laminated steel sheet, and that has good openability such that even a child or an elderly person can open the end. Therefore, the easy open end is very useful in the industry.

REFERENCE NUMERALS

1 score die
1*a* scoring edge
2 tip of die
3, 3' side of die
4 end surface
5 laminated steel sheet
6 body hook
7 chuck wall
8 panel
9 tab
10 rivet
11 score
12 panel structure
13 panel die
14 basic shell
15 center of score circle
16 center of score

The invention claimed is:

1. A method of manufacturing an easy open end, the method including the steps of using a laminated steel sheet with resin films formed on both surfaces of the laminated steel sheet, and forming a panel structure and a score, wherein a score die used for forming the score includes a scoring edge having a cross section in which a tip is a curve and two sides with the tip interposed therebetween are tangent to the curve, wherein the tip is the curve having a curvature radius ranging from 0.2 to 0.4 mm, and the two sides have elevation angles θ in a range of $0.3 \leq \tan\theta \leq 1.0$ to an end surface, wherein the panel structure is formed by a motion that is synchronous with a motion in which the score die is pressed to a surface of the laminated steel sheet during the formation of the score, such that a first time period during which the score die is in contact with the surface of the laminated steel sheet overlaps with a second time period during which a press for forming the panel structure is in contact with the surface of the laminated steel sheet, and wherein the panel structure is formed to have an average distance h from a first surface of the laminated steel sheet to a second surface of the laminated steel sheet in which the score is formed, with a portion of the panel structure connecting the first surface and the second surface, and with the first surface and second surface being separated by the average distance h.

2. The method of manufacturing the easy open end according to claim 1, wherein the panel structure is formed to satisfy the following expression:

$$-1.45t_0^2+1.76t_0-0.139 \leq h/(R^{0.5}) \leq -1.63t_0^2+2.31t_0+0.091,$$

where h (mm) is an average distance from a surface of the laminated steel sheet of the panel to a surface of the laminated steel sheet in which the score is formed, R (mm) is a distance from the center of the score to the center of the panel, and $t_0$ (mm) is a thickness of a blank sheet of the laminated steel sheet.

3. The method of manufacturing the easy open end according to claim 1, wherein during the motion for forming the panel structure and the motion in which the score die is pressed, the score die and the press for forming the panel structure simultaneously reach respective lowest points.

4. The method of manufacturing the easy open end according to claim 1, wherein the two sides of the score die, each having the elevation angles θ in the range of $0.3 \leq \tan\theta \leq 1.0$ to the end surface, have the same elevation angle.

* * * * *